US005955006A

United States Patent [19]

Charnecky

[11] Patent Number: 5,955,006

[45] Date of Patent: Sep. 21, 1999

[54] HYDRONIC HEATER MOUNTED HUMIDIFIER

[76] Inventor: Ronald S. Charnecky, 65 Forest Lake Dr., Hewitt, N.J. 07421

[21] Appl. No.: 08/948,655

[22] Filed: Oct. 10, 1997

[51] Int. Cl.[6] ..... B01F 3/04; F24F 3/14

[52] U.S. Cl. ..... 261/66; 237/78 R; 261/153; 261/DIG. 4

[58] Field of Search ..... 261/66, 153, 155, 261/158, DIG. 4; 237/78 A, 78 B, 78 C, 78 R

[56] References Cited

U.S. PATENT DOCUMENTS

| | | | |
|---|---|---|---|
| 2,276,135 | 3/1942 | Woolley | 237/78 R |
| 3,250,472 | 5/1966 | Smith | 237/78 R |
| 3,265,305 | 8/1966 | Johnson | 237/78 R |
| 3,268,169 | 8/1966 | De Bree | 237/78 R |
| 3,401,882 | 9/1968 | Neuber | 237/78 R |
| 4,284,129 | 8/1981 | Rogalski | 237/78 R |
| 4,354,984 | 10/1982 | Richardson et al. | 261/66 |
| 4,921,642 | 5/1990 | Latorraca | 261/66 |
| 5,067,473 | 11/1991 | Oh | 261/153 |
| 5,664,730 | 9/1997 | Vallieres et al. | 237/78 R |

FOREIGN PATENT DOCUMENTS

| | | | |
|---|---|---|---|
| 2906607 | 9/1980 | Germany | 261/66 |
| 270109 | 7/1989 | Germany | 261/DIG. 4 |

*Primary Examiner*—C. Scott Bushey
*Attorney, Agent, or Firm*—John P. Halvonik

[57] ABSTRACT

A combination of a humidifier system for mounting on top of the fin elements of baseboard hydronic heating system. A trough in the humidifier holds a supply of water in close connection and above the fins on the inside of the baseboard fixture. This arrangement provides the heating element to vaporize water in the trough. An optical sensor detects changes in the water supply and controls a solenoid that directs a water supply valve to refill the supply of water in the trough.

2 Claims, 6 Drawing Sheets

HYDRONIC HEATER MOUNTED HUMIDIFIER

FIELD OF THE INVENTION

The invention relates to the field of humidifying and heating and, in particular, to a combination of a novel humidifier in connection with existing baseboard heating unit. Such baseboard heating units that rely on heated water may be referred to as the elements in a hydronic heating system. Apparatus that dissipate water vapor, like that described herein, are termed humidifiers. Typical hydronic heating systems transmit and dissipate heat through a water supply system that circulates heated water through elements inside the baseboard in order to dissipate the heat in each room. The humidifier portion of the invention is mounted on top of fin elements existing in the baseboard and provides a source of water vapor that may be vaporized by heat from these elements.

BACKGROUND OF THE INVENTION

The invention combines a humidifier with baseboard fixtures found in hydronic heating systems. The purpose of a humidifier is well known. A "hydronic heating system" may be referred to generally as a heating system that relies on heated water that is circulated throughout the house which serves to dissipate heat from the elements that carry the water. The water in the hydronic system may be heated by oil, gas, as well as various other means. A system of piping carries the heated water to the elements in the separate rooms. Each room has an element, typically of fin construction, for dissipating the heat. Radiators and baseboards are well known fixtures that serve to dissipate the heat through fins mounted in such fixtures.

In each room the heat is dissipated through "fins," which are metal elements that dissipate the heat from the water in relatively rapid fashion. Typical baseboard systems have an outside covering that provides access to an arrangement of fins on the inside of the baseboard unit. The covering would typically be removed in order to install this system and the trough portion of the invention would then be attached to the heating fins. The baseboard covering would be then replaced when the system returns to operation.

It is believed that by using a humidifying system in connection with an existing hydronic heating system offers advantages over humidifiers shown in the prior art. Combining humidifying and hydronic systems in one unit permits the rapid dissipation of the water vapor as the source of such water vapor may be connected to the heating elements of the hydronic system. Combining such systems closely with one another in one fixture may make for a safer arrangement by using a common source to supply the water for both and by mounting the electrical elements of the humidifier system in a safe, out of the way place viz: the inside of the baseboard heating system.

It is believed that the invention described herein will likely find the most usage as an add on unit to an existing baseboard heating system. As such systems typically use heating fins, these fins will provide a source of heat in close connection with the trough portion of the humidifier. It is believed that the control elements for the water supply of the humidifier can be secured inside the confines of the top of the baseboard.

PRIOR ART

While there are humidifiers that are known, none that applicant is aware of are mounted within a baseboard element in a heating system. Also, there are no known humidifiers that rely on an optical sensor in order to determine water level. The use of an optical sensor is thought to eliminate the risk that a conventional float would remain stuck in a "high" position (indicating water is full) as the water level in the trough may remain quite high for long periods of time. In conventional systems minerals may build up or the calibration may be off and this can lead to getting a float stuck in the high position. An even greater threat is posed by a float getting stuck in the "low" position (indicating that there is no water); causing the system to demand more water and thereby causing water damage to the premises.

SUMMARY OF THE INVENTION

A humidifier system for mounting on the heating elements of existing baseboard heating systems. Such heating elements are typically constructed as fins. The humidifier system includes a trough that holds a supply of water above the fins and includes an optical sensor (OLS) that detects changes in the water level of the trough. The water supply of the trough may be connected to the existing water supply of the baseboard heating system. Such system may be controlled by a three way electrical solenoid that controls a water supply valve. When the water supply in the trough is full, water from a source is diverted back to the source of the water through the valve. When the optical sensor detects a change (decrease) in the water supply, the solenoid directs the valve to operate in the filling mode and water is sent to the trough until the proper water level is reached and the sensor again closes the valve. The solenoid may also divert heated water into the serpentine coil and then back to the water source, to provide additional heating.

Brackets made of resilient material are located at the bottom of the trough in order to support the trough indirectly on top of the fins in order to minimize noise and movements of the trough that may occur due to contractions and/or vibrations in the baseboard.

It is among the objectives of the invention to provide a humidifier with a control circuit that is relatively small and easily stored inside of an existing baseboard fixture.

Another objective is to provide a humidifying system that can be mounted on top of a baseboard heating elements in order to use heat from the baseboard fins in order to vaporize the water in the trough of the humidifying system.

Another objective is to provide a humidifying system for use on home heating elements that will be safe in the event of system failure, including one that uses a light sensor rather than a float in order to provide a "no water" demand in the event that the sensor is fouled with minerals, etc. and one that uses a three way diverting valve rather than a two way so that in the event of failure the three way valve will divert.

Another objective is to provide a humidifying system that can be mounted on top of existing baseboard heating elements and having an optical sensor element to detect changes in the water level of the water supply of the humidifier.

Another objective is to provide a humidifier in close connection with a hydronic system in order to minimize the space taken up by such units and to provide a humidifier that is self contained.

Another objective is to combine a humidifier system with a hydronic system in order to preheat the supply of water in the humidifier by heat supplied by the baseboard heating system.

Another objective is to provide a humidifier in connection with a baseboard heating system that uses the water supply of the hydronic heater in order to continually maintain the reservoir for the humidifier; thus eliminating the need to continually maintain and fill a separate water reservoir in a humidifier system.

Another objective is to provide a humidifier in connection with a hydronic system in order safely store electrical elements of the humidifier within the confines of a baseboard unit.

Other objectives will become known to those skilled in the art once the invention is shown and described.

DESCRIPTION OF THE PREFERRED EMBODIMENT

Figure 1:
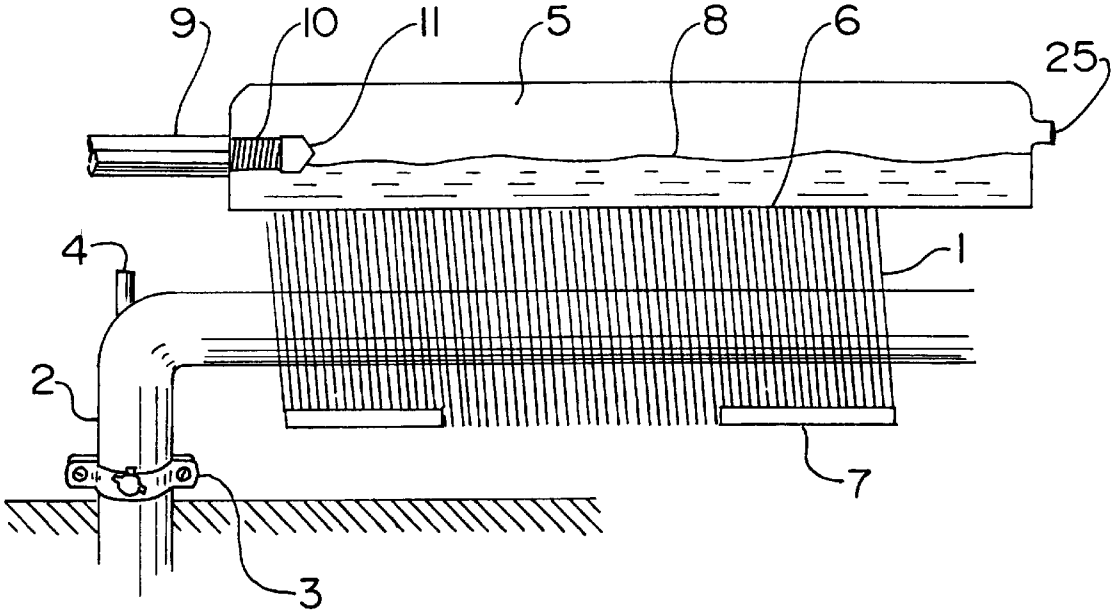
FIG. 1 Side view of heating element and humidifier.

The overall construction of the invention is as shown in FIG. 1. A three-way solenoid controlled valve is mounted at 1 and directs the flow of water from inlet 12 into the unit in FIG. 1 when the valve is in the non-filling or "diverting" mode. When a decrease in water level is sensed, the optical sensor at 9 will send a signal to a controller and a solenoid will open the passage between 36 and 37 and close that between 36 and 38 so that water will flow from 36 to 37. 12 is the inlet to the trough and this will permit water to fill the trough until full when the valve is operating in the filling mode. Water may be diverted from the pipe that feeds the baseboard unit by means of an angle tee 4 shown in FIG. 1. 3 is a saddle valve that may be used as well. 7 is a retaining bracket that may be factory installed on the baseboard unit. 25 is the serpentine tube outlet. Other types of control are possible other than solenoid, but it is preferred that the valve be a three way valve.

Figure 2:
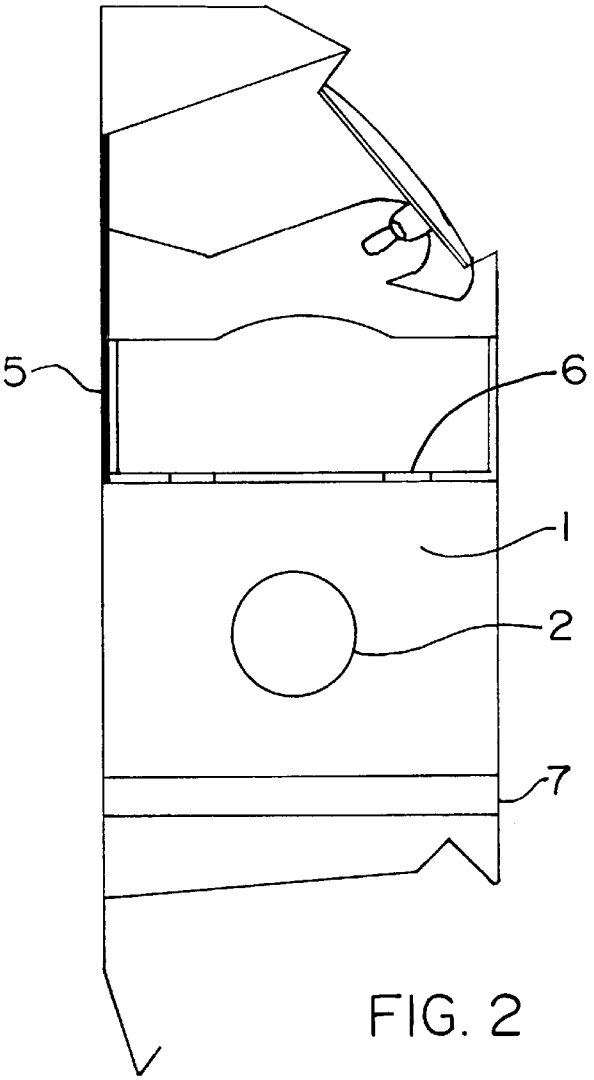
FIG. 2 End view cut away of heating element and humidifier.

The trough 5 and solenoid valve are attached to the top of fins 1 inside a baseboard as shown in FIGS. 1 and 2. The connection is indirect as the resilient brackets 40 are between the fins and the trough. The valve and the electrical control box containing the electrical elements that power the solenoid valve may be mounted at the side of the trough.

Figure 7:
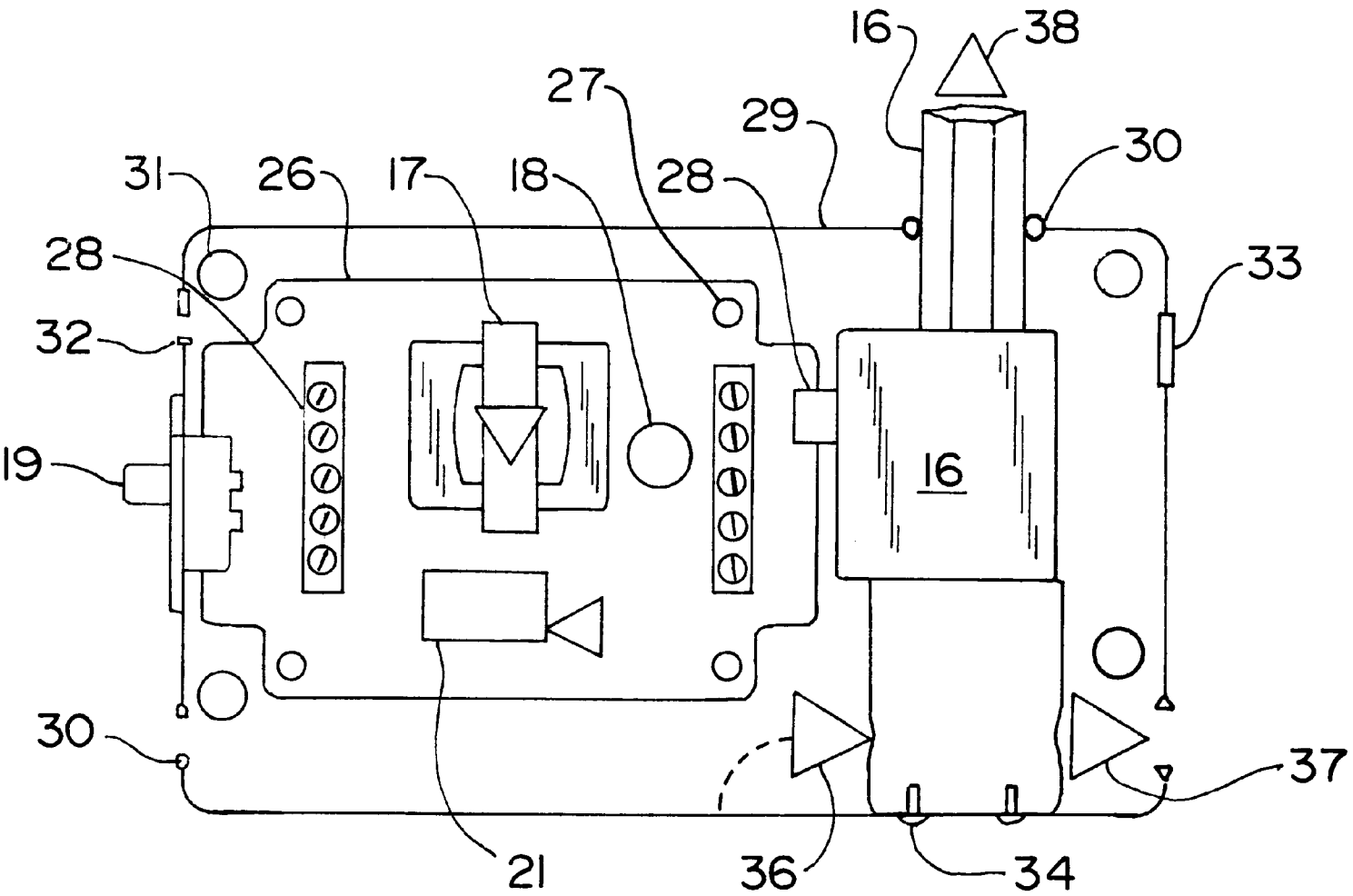
FIG. 7 control box.
Figure 8:
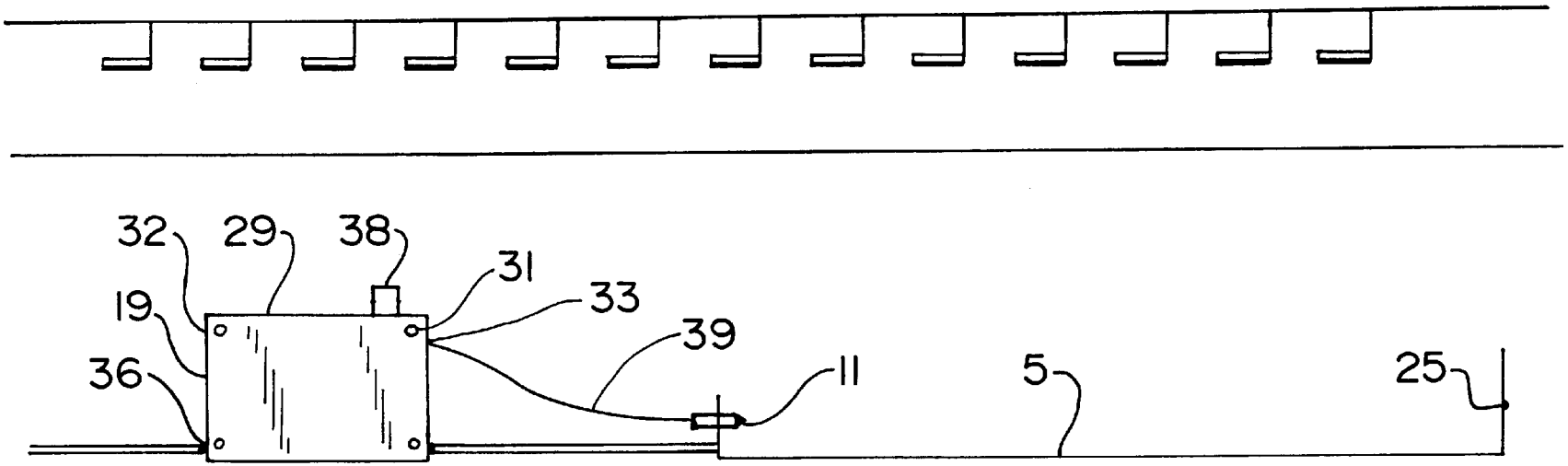
FIG. 8 Side view of layout of control box to trough.

One example of an electrical supply that may be used with the device is shown in FIG. 7. It is preferred that the electrical control elements be of rather small or miniature variety so that the housing (shown with cover removed in FIG. 1) that holds them can be conveniently mounted inside the shell or covering of the baseboard while on top of the fins or piping. In FIG. 7, 27 are PCB posts (preferably ⅛") 28 are wire terminals, 29 is a plastic case (preferably of ABS plastic) 30 are grommets (preferably ¼") 31 are case posts, 32 is a strain relief, 33 is a polarized connector; and 34 are screws. FIG. 8 show the side view of the control box and the trough. 38 is the water feed line to the serpentine tube, 36 is entrance port for the solenoid and 39 is a power lead to the OLS, 11 is the prism tip of the OLS.

Figure 5:
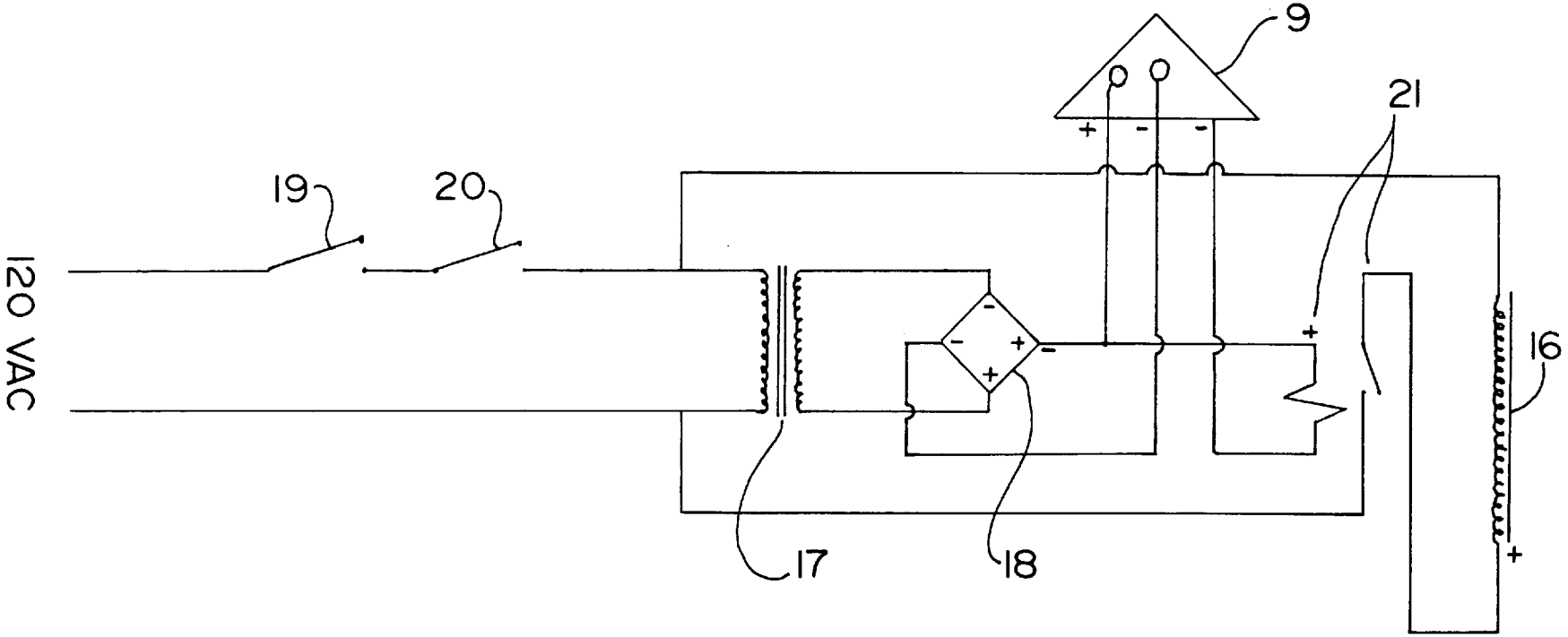
FIG. 5 Schematic of electric circuit for water supply and sensor.

An electrical schematic in FIG. 5 shows one such arrangement for powering the electrically operated solenoid valve 16. Power from an AC supply is stepped down at 17 and converted to DC by rectifier at 18. The Optical Level Sensor (OLS) 11 will detect changes in the water level in the trough and send an electric signal that will complete the switch at 21. Other circuits may be used in order to provide a make or break power source to the solenoid 16. The sensor is powered by current from the rectifier at 18. Completing the circuit shown in FIG. 5 will power the solenoid 16 so that solenoid may be opened in response to changes in the water level in the trough. When the water level reaches approximately that level shown as 8 in FIG. 1 the reservoir will be filled and the OLS will break the circuit, thereby stopping the inflow of water.

Figure 6:
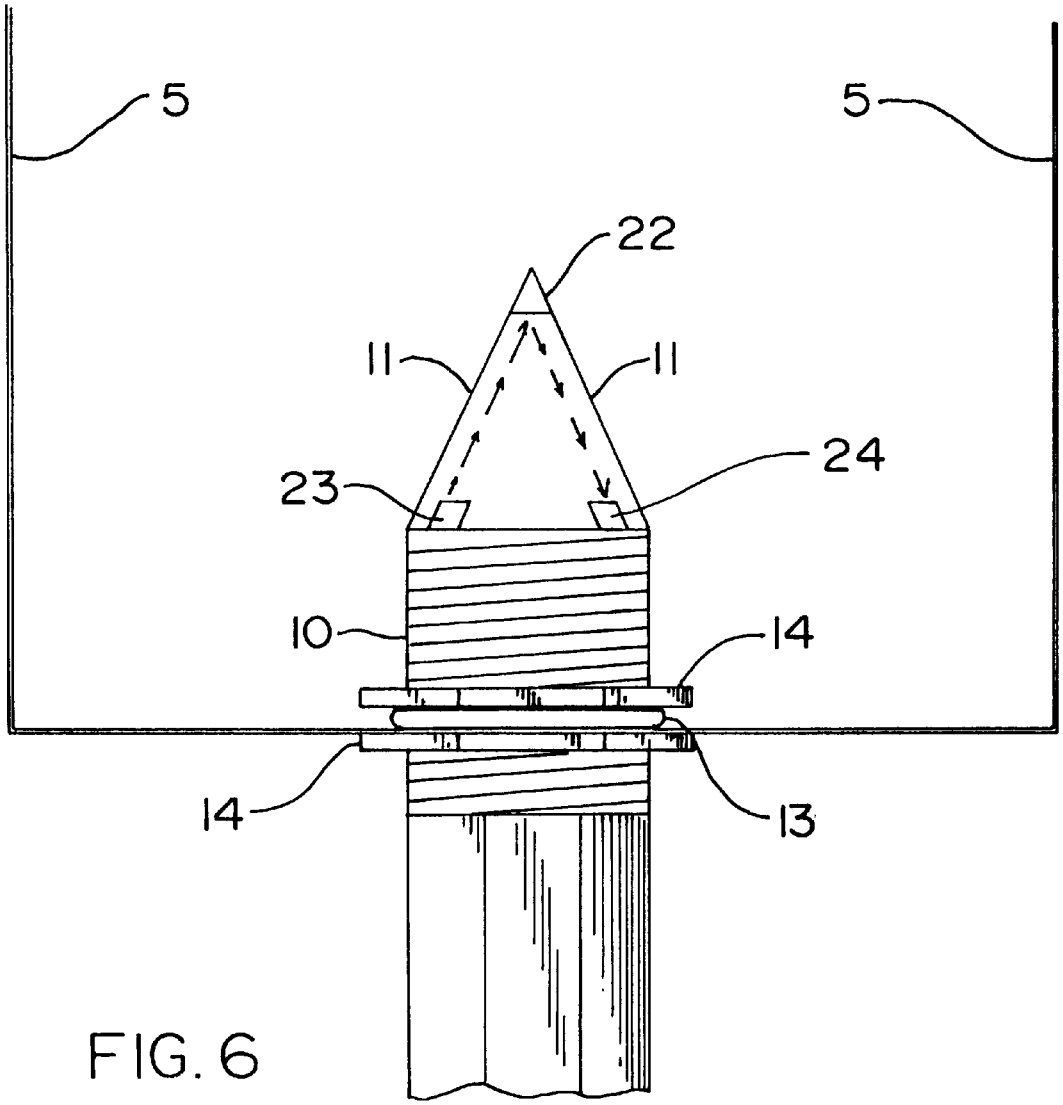
FIG. 6 Detail of OLS.

The OLS 9 is mounted by its threaded half 10 partially inside the trough 5 and will complete a circuit when light is detected at the tip 22 of the OLS, (see FIGS. 1 and 6). When no light is detected (absorption of light by water over the tip of the prism), the circuit (see FIG. 5) is broken and the solenoid 16 is not charged and the valve remains in the diverting mode. When light is detected, the sensor 9 will complete the circuit going through the rectifier 18 and thus powering the solenoid 16 and closing the switch 21. The switch 21 may be a single pole single throw switch and may be a low capacity reed relay. The sensor will power the switch when light is detected and this causes a valve in connection with 16 to open and thus fill the trough (see FIG. 3).

The OLS is an enclosed unit, see FIG. 6. There is an LED 23 (transmitter) at one side, reflecting at the tip 22 to the light sensor (24 receiver) on the other side of the OLS. The sensor should be mounted in the trough at a proper water level 8 for the trough (see FIG. 1). The tip 11 of the sensor may have a prism tip in order to better reflect the light that it may detect.

When the water is at the level of the sensor, the water there will absorb the light from the LED and no light will be detected at the receiver 24, hence, the circuit will not power the solenoid valve and the valve will be in the diverting mode. The sensor is threaded on one half 10 in order to attach to an opening in the trough. Nuts 14 may be used to facilitate this connection. A gasket 13 may be used to seal the opening where the sensor is inserted in the trough. In the event that the OLS becomes encrusted with minerals, etc. it will detect no light and as such will maintain the valve in the diverting position. This will operate as a safeguard to prevent the overflow of water in the trough in the event that the OLS fails in this manner.

In FIG. 5, 19 is an outside switch and 20 is an optional humidistat. The cutoff switch would be utilized in the event that a leak is detected or should the user want to disconnect the power supply for any reason.

Figure 3:
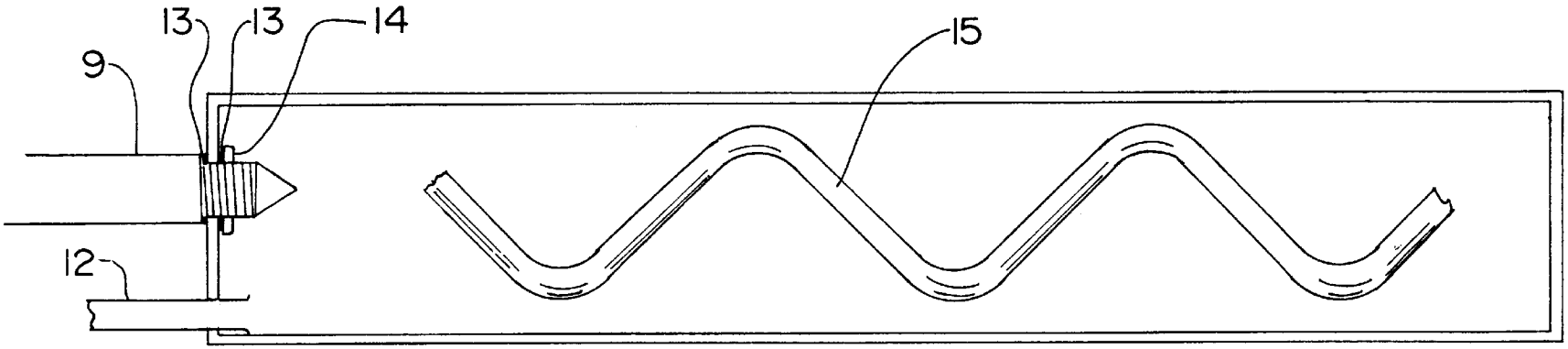
FIG. 3 Top view of humidifier and sensor.
Figure 4:
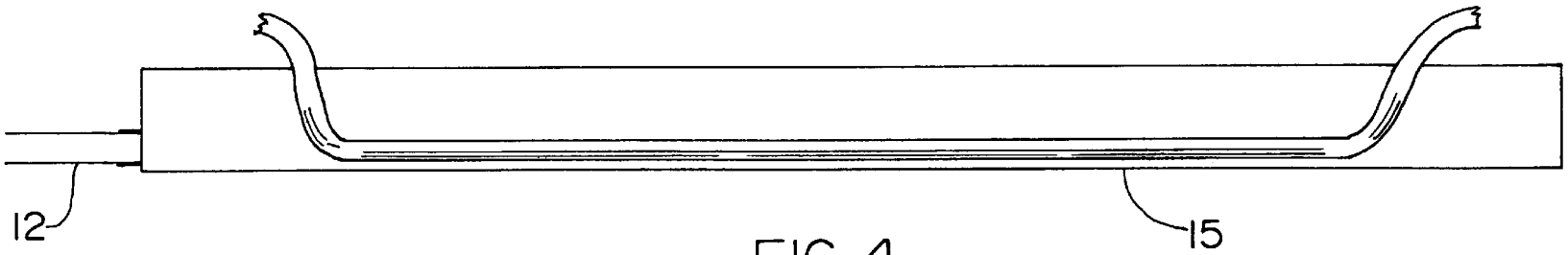
FIG. 4 side view of humidifier and serpentine tube.

The water supply tube may comprise a serpentine pipe 15 that is closely connected to the inside of the trough and submerged beneath the water level, see FIG. 3. This is so that the hot water supply may additionally heat the water within the trough when the valve is in the diverting mode. In a separate variation, an adapter may be used to connect the water supply in the fins to that going in at 12. This adapter should have a filter in order to remove materials that may be in the baseboard water supply.

The mounting brackets are shown as 6 in FIGS. 1 and 2 and may be made of such materials as polypropylene. There are preferably at least four brackets and they are mounted on the bottom of the trough. The brackets support the trough at the top edges of the fins 1 so that the bottom of the trough does not directly contact the fins. This so that the expansions and/or vibrations in the fins do not produce a sound by moving against the trough.

The somewhat resilient nature of polypropylene material of the brackets allows for some contraction of the material. Other resilient materials may be used to support the trough so long as they are not likely to be melted or combusted when in connection with the heating fins of the baseboard system which may achieve temperatures of 190° F. or more.

For installation, one would remove the cover that provides access to an element of the existing baseboard. Typical baseboard systems will only require the removal of the front panel of the system and the end caps. Removing of the front panel will typically allow access to the fins for the mounting of the trough of the humidifier. The end caps will provide access to the water supply of the hydronic heating system so that the humidifier may tap into the existing water supply of the hydronic heating system. Of course, existing baseboard units may differ in outward appearance, but many if not most such units have essentially the same elements on the inside. The system can be used with a separate water supply if desired, but is designed to be used in conjunction with the existing water supply of the hydronic heating unit.

The trough portion may be mounted on the top of the fin system inside the baseboard element by the removal of the front panel of the baseboard unit. Resilient brackets 6 in connection with the trough will support the trough a distance above the fins and prevent the trough from coming in direct contact with the heating fins of the baseboard. The baseboard covering would be then replaced when the system returns to operation.

The system preferably is used with the existing water supply (shown as tube 2 in FIGS. 1 and 2) of the hydronic heating unit. The elements at 3 and 4 (angle tee and saddle valve) are necessary at installation; they provide access to the water supply at tube 2.

The corners and/or the seams of the trough should be of welded construction in order to minimize the chances for leakage. It is preferred that the walls of the trough body should be of stainless steel construction in order to resist corrosion as the trough may be in contact with the water inside for a long time. The preferred thickness of the trough walls would be 3/16". Connecting piping may be made of stainless steel or copper.

I claim:

1. A humidifier system for use in side baseboard heating systems having fins and a space above the fins to accommodate the humidifier system, said comprising: a trough for holding water, a three way valve system in connection with said trough, said valve system comprising: a refilling passage in connection with a solenoid valve and said trough, an inlet passage in connection with a source of water and said solenoid valve; and an outlet passage in connection with said solenoid valve and said source of water, said solenoid valve having a means for directing water flow from said inlet passage to said outlet passage in one mode and for alternately directing water flow from said inlet passage to said refilling passage as a second mode in response to a signal, an optical sensor in connection with said trough and placed at a point on said trough corresponding to a predetermined water level in said trough, said sensor having means to direct an optical signal in direction parallel to said water level, said sensor having a means for providing a signal to said solenoid valve in response to a detected change in said water level that is below said predetermined water level.

2. The apparatus of claim 1 where said trough has a bottom surface having at least two feet in connection with said bottom surface, said feet constructed of resilient material for supporting said trough at a distance above the fins.

* * * * *